US006521064B1

(12) United States Patent
Tracy et al.

(10) Patent No.: US 6,521,064 B1
(45) Date of Patent: Feb. 18, 2003

(54) PYROTECHNIC BURSTER COMPOSITION

(75) Inventors: Gene V. Tracy, Jarrettsville, MD (US); David H. Anderson, Stewartstown, PA (US); David W. Smith, White Hall, AR (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/896,986

(22) Filed: Jul. 2, 2001

(51) Int. Cl.[7] ..... C06B 33/06; C06B 29/02; C06B 29/12

(52) U.S. Cl. ..... 149/42; 149/77; 149/83

(58) Field of Search ..... 149/42, 83, 77

(56) References Cited

U.S. PATENT DOCUMENTS 3,257,801 A * 6/1966 Martinez et al. ..... 60/35.4
3,609,115 A * 9/1971 Sammons et al. ..... 260/32.4
3,627,596 A * 12/1971 Green ..... 149/19
3,745,076 A * 7/1973 Sickman et al. ..... 149/19
3,745,927 A * 7/1973 Tanner et al. ..... 102/103
3,779,825 A * 12/1973 Blackwell ..... 149/19
4,116,131 A * 9/1978 Shafer et al. ..... 102/103
4,274,893 A * 6/1981 Mars et al. ..... 149/2

* cited by examiner

*Primary Examiner*—Michael J. Carone
*Assistant Examiner*—Aileen B. Felton
(74) *Attorney, Agent, or Firm*—Ulysses John Biffoni

(57) ABSTRACT

Pyrotechnic burster composition combines high explosive energy when confined, with reduced ignition hazard when unconfined. The composition includes pyrotechnic mixtures of $KClO_4$, metal powders, and pentaerythritol or terephthalic acid.

17 Claims, 1 Drawing Sheet

PYROTECHNIC BURSTER COMPOSITION

The invention described herein may be manufactured, used, and licensed by the U.S. Government for governmental purposes without the payment of any royalties thereon.

BACKGROUND OF THE INVENTION

1. Field of the Invention

This invention relates to a pyrotechnic burster composition that produces its effect as the result of an explosion.

2. Description of Related Art

Pyrotechnic compositions are widely used to produce a loud report and/or flash for a variety of applications. Typically, black powder or various "flash" compositions are used in this role.

More recently, pyrotechnic flash compositions have provided the energy for "sting ball" or "stun" type devices used by military and law enforcement personnel. Many of the flash compositions used in these devices, however, are dangerous to manufacture and handle because of their tendency to explode if initiated when unconfined. The same can be said for black powder, which has been employed as a bursting material for hundreds of years. The safety issues associated with the manufacture and use of black powder and flash type compositions are well known. See, e.g., J. A. Conking, *Chemistry of Pyrotechnics,* Marcel Dekker, Inc., New York, N.Y. , 1985, pages 3 and 176.

SUMMARY OF THE INVENTION

It is an object of the present invention to provide a pyrotechnic burster composition that combines good explosive energy when confined, with reduced ignition hazard when unconfined.

The composition includes pyrotechnic mixtures of $KClO_4$, metal powders, and pentaerythritol or terephthalic acid.

By virtue of its good explosive energy when confined and reduced ignition hazard when unconfined, the composition exceeds the performance of both black powder and a traditional flash composition.

BRIEF DESCRIPTION OF THE DRAWINGS

Other objects, features, and advantages of the present invention will become more fully apparent from the following detailed description of the preferred embodiments, the appended claims, and the accompanying drawings. As depicted in the drawings:

DESCRIPTION OF THE PREFERRED EMBODIMENTS

Figure 1:
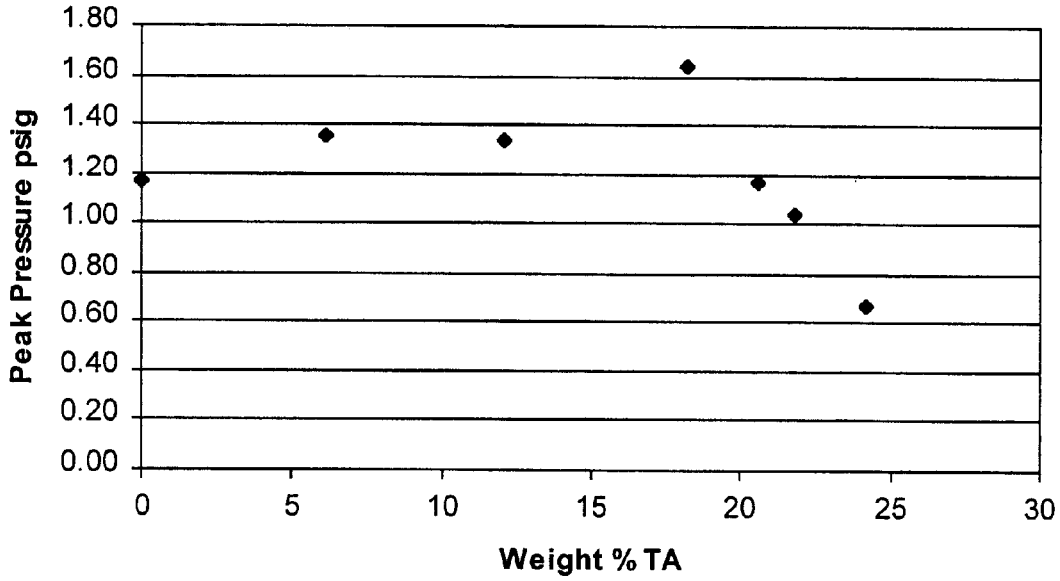
FIG. 1 is a plot of composition (weight % terephthalic acid) versus measured peak pressure for selected stoichiometric compositions containing $KClO_4$, aluminum powder and terephthalic acid ("TA").

The present invention will be disclosed in terms of the currently perceived preferred embodiments thereof.

When unconfined, the formulations described herein burn relatively slowly and, in some cases, are relatively difficult to ignite. When confined in a burster type device, however, and initiated using pyrotechnic ignition stimuli, the compositions react so quickly that the device explodes.

Initially, the inventors used mixtures comprising potassium perchlorate ($KClO_4$), terephthalic acid ($C_6H_4(COOH)_2$), and aluminum (Al). They found that 5.00 grams of loose, stoichiometric mixtures of these components burned at an approximate rate of 1.0 gram per second when placed in a small aluminum container with an open top. When this mixture was confined in a burster tube, however, it exploded with a loud report. Subsequent experiments replaced the aluminum powder in the composition with titanium, boron, and "magnalium" (magnalium is an alloy of aluminum and magnesium). All of the formulations performed well.

Formulations containing pentaerythritol ($C(CH_2OH)_4$) rather than terephthalic acid also performed well. Combinations of potassium perchlorate, aluminum, and pentaerythritol can be formulated such that they are fairly difficult to ignite when unconfined, but yield a powerful explosion when confined. These mixtures do not contain components that are unusually toxic or harmful to the environment. The projected products of the reactions are also relatively benign. The procedures used in the manufacture of these mixtures are standard pyrotechnic operations.

Initially, the inventors carefully blended very small quantities of the dry reactants by hand. Performance was outstanding and a formulation based on the concepts presented in this disclosure was incorporated into an item being developed for military use. Employment in the production item required a binder, for which the inventors used nitrocellulose. The wet mixing used to incorporate nitrocellulose into the mixtures also resulted in greater safety when blending the larger quantities used for developmental work and production. As long as the components are adequately mixed, other blending methods may achieve a mixture that performs well.

A preferred embodiment of the wet blending method comprises the following steps.

The individual components of the mixture are carefully weighed out and individually sieved to remove any aggregates that may have formed during storage. The metallic components are not sieved.

The sieved components are then carefully transferred to the mixing bowl. It is advantageous to interpose the pentaerythritol or terephthalic acid component between the potassium perchlorate layer and the metallic fuel.

Nitrocellulose binder, a solution of nitrocellulose dissolved in acetone, is then added.

The materials are carefully wetted. Additional acetone is added if necessary to achieve the proper consistency for blending. The mixture is then blended until there is adequate mixing of the individual components and sufficient acetone evaporates to yield a damp powder.

The damp powder is then transferred to a drying tray and placed in a forced air oven at 140 degrees F.

After drying, the powder is placed in a burster tube previously plugged at one end. The burster tubes are made from wound paper, phenolic resin or nylon, preferably nylon. All types worked well, and it is assumed that any container that provides sufficient confinement will result in the burn rate accelerating to the point of explosion. The typical quantity of mix used in the bursting devices varied between 5.00 and 10.00 grams. Quantities smaller or larger than this may be used with a suitable container.

The burster is initiated through a hole in a plug inserted in the opposite end of the burster tube to seal it. The degree of confinement is a very important aspect of performance. Insufficient confinement typically results in the ejection of reaction products through the opening (if it is too large) or an explosion of reduced force.

The composition can be ignited by a variety of ignition sources, including, for example, an electric match, a pyrotechnic ignition mix, and "Quickmatch." (Quickmatch, which is described in MIL-Q-378B, is essentially a cotton wick impregnated with black powder.) Achieving an explosive reaction rate does not appear to require any specific type of ignition stimulus.

The explosive energy was evaluated by measuring the pressure of the blast wave 9 feet away from the burster tube. A PCB Piezotronics Model 106B High Intensity microphone with PCB Model 482 signal conditioner measured the pressure wave from the explosion. The microphone and signal conditioner were flush mounted in a 6 inch×6 inch×1 inch aluminum plate, and oriented face-on to the wave. A Stanford Research Systems SRS785 signal analyzer set in the capture mode, with filtering off, digitized the output of the microphone at 252 kHz.

The pressure versus time data was processed to yield the peak pressure and the pressure wave impulse ($\int$ pdt). See generally *Principles of Explosive Behavior,* Engineering Design Handbook, AMCP 706–180, April 1972.

The peak pressure was determined by using a least-square fit of the peak's fall-off points and then calculating the pressure at the start of the peak. The pressure wave impulse was calculated as the maximum of the sum of the pressure by the time interval ($\Sigma p\Delta t$). Table 1 summarizes the results of varying the ratios of aluminum powder to pentaerythritol ("PE") or terephthalic acid ("TA") with a stoichiometric quantity of potassium perchlorate.

of Dallas, Tex. These electric matches have a bridgewire that, when electric current is applied, initiates a small amount of pyrotechnic material surrounding it. These particular matches use lead mononitroresorcinate, $KClO_3$, charcoal, and nitrocotton. They are roughly the size of a common match, but their output is a brief flash rather than a sustained flame. A "no" in Column 2 indicates no sustained reaction. If the sample failed to ignite and burn when the match was activated, a piece of quickmatch was used as the ignition stimulus. All of the samples listed were sufficiently reactive to ignite and burn with this ignition source, even when unconfined.

The burn times, Column 3, were determined by hand with a stopwatch and are approximate. Timing fast reaction rates in this manner accurately is especially difficult. A burn time in the one-second region resembles a slow flash. Since the sample sizes were all the same, the burn rate (g/sec) is just the sample size (6 g) divided by the burn time.

Column 4 lists the peak pressure in lbs/in$^2$, measured 9 feet from the source, developed when the samples were confined in a burster configuration and initiated. Column 5 is the impulse of the explosion lbs/in$^2$·sec when confined. Analysis of the pressure versus time data yielded the peak pressure and pressure wave impulse ($\int$ pdt). The peak pressure was determined using a least-square fit of the peak's fall off points and the calculated pressure at the start of the peak. The pressure wave impulse was calculated as the maximum of the sum of the pressure by the time interval ($\Sigma p\Delta t$).

Each of the tests used 8.00 grams of a formulation. The burster tubes were made from pieces of phenolic tubing 2.60 inches long with a nominal internal diameter of 0.625 inch

TABLE 1

| | M-100 Match (unconfined) Result | Burn Time (unconfined) Sec | Pressure (confined) Psi | Impulse (confined) Psi.sec | Al % | PE % | $KClO_4$ % |
|---|---|---|---|---|---|---|---|
| PE Formulas | | | | | | | |
| BP6** | Yes | <1 | 0.46 | 7.3E-05 | 0 | 0 | 0 |
| 20101 | Yes | ≅1 | 1.17 | 2.3E-04 | 34.2 | 0 | 65.8 |
| 20102 | Yes | 2 | 1.41 | 3.6E-04 | 25.7 | 6.2 | 68.1 |
| 20103 | Yes | 4 | 1.62 | 3.6E-04 | 17.1 | 12.4 | 70.5 |
| 20104 | No | 7.2 | 2.44 | 4.6E-04 | 8.6 | 18.5 | 72.9 |
| 21503 | No | 8.5 | 1.49 | 3.2E-04 | 5.1 | 21 | 73.9 |
| 21504 | No | 11.6 | 0.89 | 1.7E-04 | 3.4 | 22.2 | 74.4 |
| 30701 | No | 12.5 | 0.81 | 1.4E-04 | 2.6 | 22.8 | 74.6 |
| 30703 | No | 16.2 | 0.60 | 1.1E-04 | 1.4 | 23.7 | 74.9 |
| 20105 | No | 17.3 | 0.64 | 1.1E-04 | 0 | 24.7 | 75.3 |
| TA Formulas | | | | | | | |
| 20106 | Yes | 1.4 | 1.35 | 3.2E-04 | 25.6 | 6.1 | 68.3 |
| 20107 | Yes | 2.1 | 1.34 | 2.8E-04 | 17.1 | 12.1 | 70.8 |
| 20108 | Yes | 4.3 | 1.64 | 3.5E-04 | 8.5 | 18.2 | 73.3 |
| 21501 | No | 4.2 | 1.17 | 2.5E-04 | 5.1 | 20.6 | 74.3 |
| 21502 | No | 3.9 | 1.03 | 2.0E-04 | 3.4 | 21.8 | 74.8 |
| 20109 | No | 4.8 | 0.67 | 1.1E-04 | 0 | 24.2 | 75.8 |

*All of the above formulations contained an additional 2 percent nitrocellulose added as a binder
**BP6 is Class 6 Black Powder Columns 2 and 3 list the results of the unconfined burn tests. The inventors placed 6.00. grams of the sample powder in an aluminum container with an open top that was 2.26 inches long with an internal diameter of 1.13 inches. Column 2 details the results of initiating with an M-100 electric match, manufactured by the Atlas Powder Company and an outside diameter of 0.750 inch. The plugs, made from phenolic resin rod, were 0.500 inch long. Ignition was by an M-100 electric match inserted through a hole in one of the plugs. This hole fit tightly around the firing leads of the electric match and was sealed with epoxy.

The composition of Formula 20101 lacks pentaerythritol and terephthalic acid. It is very similar to Formula #119 listed on page 370 in the Flash Report section of Dr. Herbert Ellern's book *Military and Civilian Pyrotechnics.* Dr. H. Ellern, *Military and Civilian Pyrotechnics,* Chemical Publishing Company Inc., New York, N.Y., 1968, Formula 119, page 370. Formula #119 is 34 percent Al and 66 percent $KClO_4$. Many of the formulations in Table 1 outperform Formula #119.

A review of Table 1 also reveals the following. First, the formulas containing higher percentages of pentaerythritol or terephthalic acid exhibit much less sensitivity to the output from an M-100 electric match than the sample that represents a traditional flash composition (Formula 20101) and Class 6 Black Powder (BP6). In these tests, the M-100 failed to ignite unconfined formulations that contained 18.5 percent or greater pentaerythritol. Mixtures containing terephthalic acid were somewhat more sensitive than the pentaerythritol mixtures to the M-100. In mixtures that contained 20.6 percent or greater terephthalic acid were difficult to ignite with the M-100.

Second, once an unconfined formulation ignited, the burn rate decreased tremendously in the formulations that contained either pentaerythritol or terephthalic acid, as compared to Class 6 Black Powder (BP6) or the inventors' Formula 20101. The formulas that contained pentaerythritol were particularly effective in this regard. The combination of requiring greater ignition stimulus when unconfined than traditional formulations and a greatly reduced burn rate when unconfined increases safety in manufacturing and handling. When tested for ignitability and burn time in the manner described above, both Class 6 and Class 8 black powder exhibited a burn time of less than one second. The output of an M-100 match easily ignites black powder.

Third, these formulations performed very well in a burster configuration. Columns 4 and of Table 1 indicate that many of the formulations outperformed the traditional flash composition (Formula 20101), and all of the samples outperformed Class 6 Black Powder ("BP6"), most by a wide margin. The inventors found that these mixtures greatly outperformed black powder, when used in a device that explodes and scatters rubber balls at high velocity.

To determine the effect that consolidation of the loose powder had on the unconfined bum time, the inventors employed a mixture based on Formula 30701 with a $KClO_4$ particle size smaller than that of the other formulations. Four 6.00 g samples of this mixture were consolidated at 3160 lbs/in$^2$ in the same type of aluminum containers used for the unconfined burn tests. M-100 matches failed to ignite any sample. Attempts to ignite the consolidated samples with quickmatch were not entirely successful, with only 3 out of 5 igniting. The burn time of the consolidated mixture was slightly greater (12.3 versus 11.6 sec) than that of the loose mixture.

Figure 2:
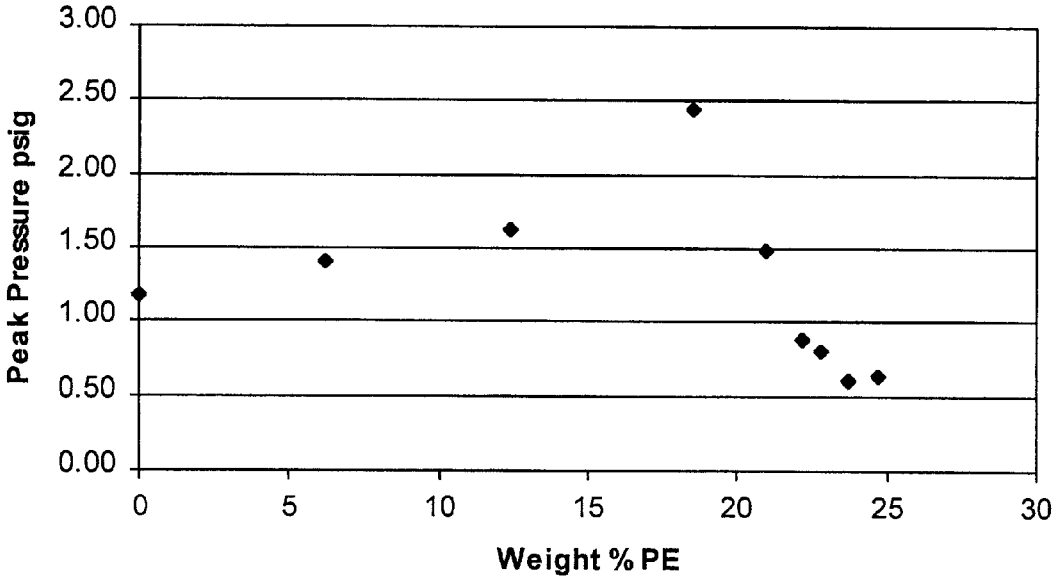
FIG. 2 is a plot of composition (weight % pentaerythritol) versus measured peak pressure for selected stoichiometric compositions containing $KClO_4$, aluminum powder and pentaerythritol ("PE").

FIG. 1 is a plot of composition (weight % terephthalic acid) versus measured peak pressure for selected compositions containing $KClO_4$, aluminum powder and terephthalic acid. In FIG. 2, pentaerythritol ("PE") replaces terephthalic acid ("TA").

While the tests described above used aluminum as the metallic fuel, other reactive fuels are viable candidates. For example, titanium, magnalium, and boron were successful in limited tests.

Formulation #1 of Table 2 contains two metallic components (aluminum and magnesium) that provide a special effect when combined, and other combinations of fuels will provide other specific effects as needed. Formulations utilizing magnesium as the sole metallic component should also perform well. Formulation #2 in Table 2, when confined, explodes with a great deal of power. Indeed, it proved excessive for a specific system under development, and Formulation #3 took its place.

TABLE 2

| | Form. 1 | Form. 2 | Form. 3 |
|---|---|---|---|
| $KClO_4$ | 72.1 | 73.2 | 74.59 |
| Pentaerythritol | — | 17.9 | 22.85 |
| Terephthalic acid | 17.3 | — | — |
| Aluminum | 5.1 | 8.9 | 2.56 |
| Magnesium | 5.6 | — | — |

The inventors experimented with only two organic components, pentaerythritol and terephthalic acid, to moderate the unconfined reaction rate, while still providing an explosive reaction rate when confined. Other organic compounds with similar physical and chemical properties should generate similar effects. Without being bound in any way, the inventors believe that these two organic compounds affect reaction rates as a consequence of their transition(s) from a solid to a vapor phase. Terephthalic acid sublimes at temperatures greater than 300° C. *Handbook of Chemistry and Physics,* 61$^{st}$ Ed., CRC Press, Inc., Boca Raton, Fla., R. C. Weast, editor, 1980, page C-582. Pentaerythritol melts at 262° C. and boils at 276° C. *Hawley's Condensed Chemical Dictionary,* 11$^{th}$ Ed., Revised by N. I. Sax and R. J. Lewis, Sr., Van Nostrand Reinholt Company, New York, N.Y., 1987, page 882.

Pentaerythritol's boiling point is unusually close to its melting point, and the transition to a vapor phase is readily achieved in the environment of a burning pyrotechnic. (Some sources indicate that pentaerythritol may also sublime. See, e.g., *Handbook of Chemistry and Physics,* page C-458.) These endothermic transitions to the vapor state absorb energy, but when sufficient energy is present to negate this effect, the same vapor is the most reactive physical state of the organic component for ignition. The ignition point of a mixture consisting of 66.7 percent $KClO_4$ and 33.3 percent Al was reported as 446° C. J. A. Conkling, *Chemistry of Pyrotechnics,* page 100; F. L. McIntyre, "A compilation of Hazard and Test Data for Pyrotechnic Compositions," Report ARLCD-CR-80047, U.S. Army Armament Research and Development Command, Dover, N.J., 1980. This is considerably higher than the temperatures of the above endothermic transitions.

The particle size of the individual components of a pyrotechnic mixture has a major effect on the reaction rate and performance. In all cases, the materials were of the typical size used in pyrotechnic compositions of this type. The $KClO_4$ used in the tests was less than 425 micrometers, preferably less than 250 micrometers, more preferably about 15 to 25 micrometers. In sieve size distribution tests performed by hand, 100 percent of the $KClO_4$ particles passed through a #40 sieve (425 micrometers); 100 percent of the $KClO_4$ particles passed through a #60 sieve (250 micrometers): 65.4 percent passed through a #80 sieve (180 micrometers); 29.7 percent passed through a #100 sieve (150 micrometers); 14.4 percent passed through a #120 sieve (125 micrometers); 12.7 percent passed through a #140 sieve (106 micrometers); 10.5 percent passed through a #170 sieve (90 micrometers) and was collected in the drop pan. The most preferred $KClO_4$ particles were MIL-P-217A, Grade A, Class 4, having a size of about 15 to 25 micrometers.

The Al used in the tests was less than 50 micrometers. Preferred Al included ASTM D962 Type 1, Class B aluminum having a size of about 9–15 micrometers, most preferably about 12.6 micrometers, and a surface area of about 0.58 $m^2/cm^3$ to 0.78 $m^2/cm^3$, most preferably about 0.68 $m^2/cm^3$. Preferably, a maximum of one percent was retained by a 325-micrometer mesh.

The particles of pentaerythritol and terephthalic acid were less than 600 micrometers in size, preferably less than 425 micrometers, most preferably less than 250 micrometers. The tested pentaerythritol, which was at least 98 percent pure, performed better than the terephthalic acid. One hundred percent of the pentaerythritol passed through a #60 sieve (250 micrometers). The binder solution contained nitrocellulose (MIL-N-244, Grade D) and acetone (SPEC O-A-0051).

Another important safety feature of the preferred formulations, such as Formulation #3 of Table 2, is the relatively low heat produced in the reaction as compared to traditional flash compositions that contain much more metal fuel. Formula 20101, a traditional flash type composition described in Table 1, yields approximately 2.54 kcal of heat per gram. Formula #3 of Table 2 yields approximately 1.30 kcal of heat per gram. This is slightly more than half the thermal yield of the flash composition containing only the stoichiometric quantities of $KClO_4$ and Al. The combination of less thermal output and greatly reduced unconfined burn rate makes the invented formulas much safer to manufacture and handle.

The present invention, therefore, provides excellent pyrotechnic mixtures of $KClO_4$, metal powders, and pentaerythritol or terephthalic acid for burster type applications. The explosive force generated with selected compositions exceeds that of black powder and at least one traditional flash composition. The ignition and burning characteristics are also more, favorable from a safety standpoint.

While only certain preferred embodiments of this invention have been shown and described by way of illustration, many modifications will occur to those skilled in the art and it is to be understood that all that fall within the true spirit and scope of this invention are included herein.

What is claimed is:

1. A pyrotechnic burster composition comprising potassium perchlorate, at least one metal powder, and at least one of pentaerythritol and terephthalic acid.

2. The composition of claim 1, wherein the at least one of pentaerythritol and terephthalic acid comprises pentaerythritol.

3. The composition of claim 1, wherein the at least one of pentaerythritol and terephthalic acid comprises terephthalic acid.

4. The composition of claim 2, wherein the pentaerythritol comprises particles having a size of less than 600 micrometers and the potassium perchlorate comprises particles having a size of less than 425 micrometers.

5. The composition of claim 4, wherein the pentaerythritol comprises particles having a size of less than 250 micrometers and the potassium perchlorate comprises particles having a size of less than 250 micrometers.

6. The composition of claim 5, wherein the potassium perchlorate comprises particles having a size of 15 to 25 micrometers.

7. The composition of claim 3, wherein the terephthalic acid comprises particles having a size of less than 600 micrometers and the potassium perchlorate comprises particles having a size of less than 425 micrometers.

8. The composition of claim 7, wherein the terephthalic acid comprises particles having a size of less than 250 micrometers and the potassium perchlorate comprises particles having a size of less than 250 micrometers.

9. The composition of claim 8, wherein the potassium perchlorate comprises particles having a size of 15 to 25 micrometers.

10. The composition of claim 1, wherein the metal powder is selected from the group consisting of aluminum, magnesium, boron, titanium and magnalium.

11. The composition of claim 10, wherein the metal powder is aluminum.

12. The composition of claim 11, wherein the metal powder is aluminum having a particle size of less than about 50 micrometers and a surface area of about 0.58 $m^2/cm^3$ to 0.78 $m^2/cm^3$.

13. The composition of claim 12, wherein the aluminum has a particle size of about 12.6 micrometers and a surface area of about 0.68 $m^2/cm^3$.

14. The composition of claim 6, wherein the metal powder is aluminum having a particle size of less than about 50 micrometers and a surface area of about 0.58 $m^2/cm^3$ to 0.78 $m^2/cm^3$.

15. The composition of claim 14, wherein the aluminum has a particle size of about 12.6 micrometers and a surface area of about 0.68 $m^2/cm^3$.

16. The composition of claim 9, wherein the metal powder is aluminum having a particle size of less than about 50 micrometers and a surface area of about 0.58 $m^2/cm^3$ to 0.78 $m^2/cm^3$.

17. The composition of claim 16, wherein the aluminum has a particle size of about 12.6 micrometers and a surface area of about 0.68 $m^2/cm^3$.

* * * * *